US005189793A

United States Patent [19]

Ratzon et al.

[11] Patent Number: 5,189,793

[45] Date of Patent: Mar. 2, 1993

[54] CUTLERY PIECE

[76] Inventors: Eli Ratzon, 11 Ha'gadna St., Petach-Tikva 49231; Itzhak Hadad, 13 David Raziel St., Petach-Tikva 49246, both of Israel

[21] Appl. No.: 840,265

[22] Filed: Feb. 24, 1992

[30] Foreign Application Priority Data

Mar. 6, 1991 [IL] Israel ..... 97456

[51] Int. Cl.[5] ..... A47J 43/28

[52] U.S. Cl. ..... 30/123; 30/142; 30/324

[58] Field of Search ..... 30/324, 123, 142; 446/81, 175

[56] References Cited

U.S. PATENT DOCUMENTS

| | | | |
|---|---|---|---|
| 2,800,825 | 7/1957 | Toussaint | 446/81 |
| 3,510,643 | 5/1970 | File | 30/123 |
| 3,839,793 | 10/1974 | Crapio | 30/123 |
| 4,207,673 | 6/1980 | DiGirolamo et al. | 30/142 |
| 5,075,970 | 12/1991 | Albert | 30/123 |

*Primary Examiner*—Douglas D. Watts
*Assistant Examiner*—Hwei-Siu Payer
*Attorney, Agent, or Firm*—Oliff & Berridge

[57] ABSTRACT

A cutlery piece has a food holding portion, a handle and an electronic device capable of generating light or sound. The electronic device comprises a light sensor in the food holding portion and upon receipt of an electric input from this sensor, after a period of darkness, the electronic device generates a transient light or sound signal.

7 Claims, 3 Drawing Sheets

CUTLERY PIECE

FIELD OF THE INVENTION

The present invention concerns a cutlery piece, particularly for babies and small children, which emits a rewarding signal after food intake therefrom.

BACKGROUND OF THE INVENTION

Small children are often reluctant to eat, especially in the first stages of spoon-feeding. Parents take great effort in the form of singing, speaking or story telling in order to convince the child to eat.

Rewarding signals such as melody or flashing lights are very useful in educating children to perform desired tasks. Thus, for example, in order to educate children to ease themselves into potties, such potties comprising an electronic device in which moisture closes an electrical circuit which activates music or a flash of light are used, and after performing the desired task, the child receives such a rewarding signal.

It would have been highly desirable to provide a cutlery piece such as a spoon or the like which is capable of providing the child with a rewarding signal upon emptying the food therefrom, thus turning feeding into a joyful event.

DESCRIPTION OF THE INVENTION

The present invention provides a cutlery piece, such as a spoon or the like, comprising a food holding portion and a handle, characterized in that said cutlery piece has electronic means capable of providing a transient audio or visual output signal when one or both of the faces of the food holding portion are exposed to light after a period of no light exposure (hereinafter at times, "darkness").

Said output signal is preferably one which is pleasing to small children and it can be an audio output signal such as music, synthesised words and the like; or a visual signal such as flashing lights, coloured lights and the like.

Said electronic means is capable of transiently activating an audio or visual output signal upon exposure of said sensor to light after a period of darkness. It comprises a light sensor and a signal generating means, which latter comprises a battery, an electronic control and activation element (hereinafter at times, "control element") and an output element such as a miniature loud speaker, one or more light emitting diodes etc. The capability to activate an output signal upon exposure to light after a period of darkness may rest in the properties of the sensor, i.e. the sensor desensitizes after a prolonged exposure to light and resensitizes only after a period of darkness; or alternatively this capability may rest in the properties of the control element. Such control elements which are capable of giving a transient electric output signal upon receipt of an electric input signal and then being capable of giving another transient electric output signal only after a certain period of time in which the electrical input signal stopped, are known per se and may be found in a large number of devices, such as, for example musical cups, musical cards, etc.

The light sensor may, for example, be a photoelectric cell in which the output potential changes as a result of exposure to light, or a variable resistor which changes its resistance upon exposure to light. Both kinds of light sensor as well as other kinds are all known per se.

The sensor is associated with the food holding portion and may be embedded therein or may be enclosed within a small space adapted to receive same. The signal generating means is also preferably embedded or enclosed within a space in a portion of said cutlery piece and this later portion may suitably form part of the handle, be located between the handle and the food holding portion, etc.

The light sensor should receive sufficient light for its activation either through one or both of the overlaying parts of the faces of the food holding portion which should thus transmit light to a sufficient degree to activate the sensor. It is clear that the requirements for transparency of said part and the requirements for sensitivity of the light sensor are dependent on one another: where the sensitivity of the sensor is high, the transparency may be lower and vice versa.

Where the light sensor is adapted to receive light transmitted through the top face of the food holding portion, the light sensor is subjected to darkness either by placing food on the top face or by insertion of this portion into the mouth. The removal of food therefrom and/or the withdrawal of said portion from the mouth exposes the light sensor to light, thus activating the signal generating means.

Where the sensor is adapted to receive light transmitted through the bottom face of the food holding portion, the sensor is exposed to darkness only after inserting the food holding portion into the mouth, and upon withdrawal of same the light sensor is exposed to light and activates the signal generating means in a similar manner as above.

As will no doubt be appreciated by the artisan, for a prolonged and reliable operation, the entire electronic means should be sealed from the outside to avoid exposure to moisture as well as protection from physical damage from the child's teeth or due to washing.

The cutlery piece in accordance with the present invention is suitably made of various plastic or ceramic materials.

BRIEF DESCRIPTION OF THE DRAWING

For better understanding, the invention will be described in the following with reference to a non-limiting specific embodiment depicted in the annexed drawings. In the drawings.

DESCRIPTION OF A SPECIFIC EMBODIMENT

Figure 1:
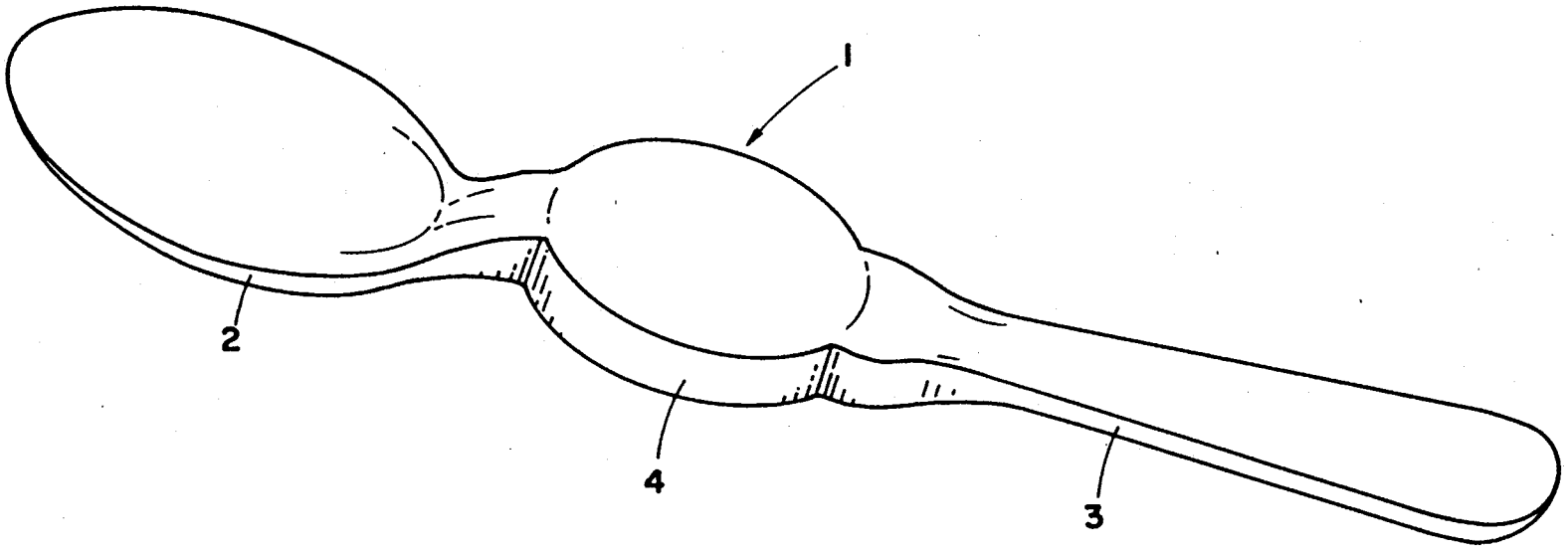
FIG. 1 shows a perspective view from above of a spoon according to one embodiment of the present invention.
Figure 2:
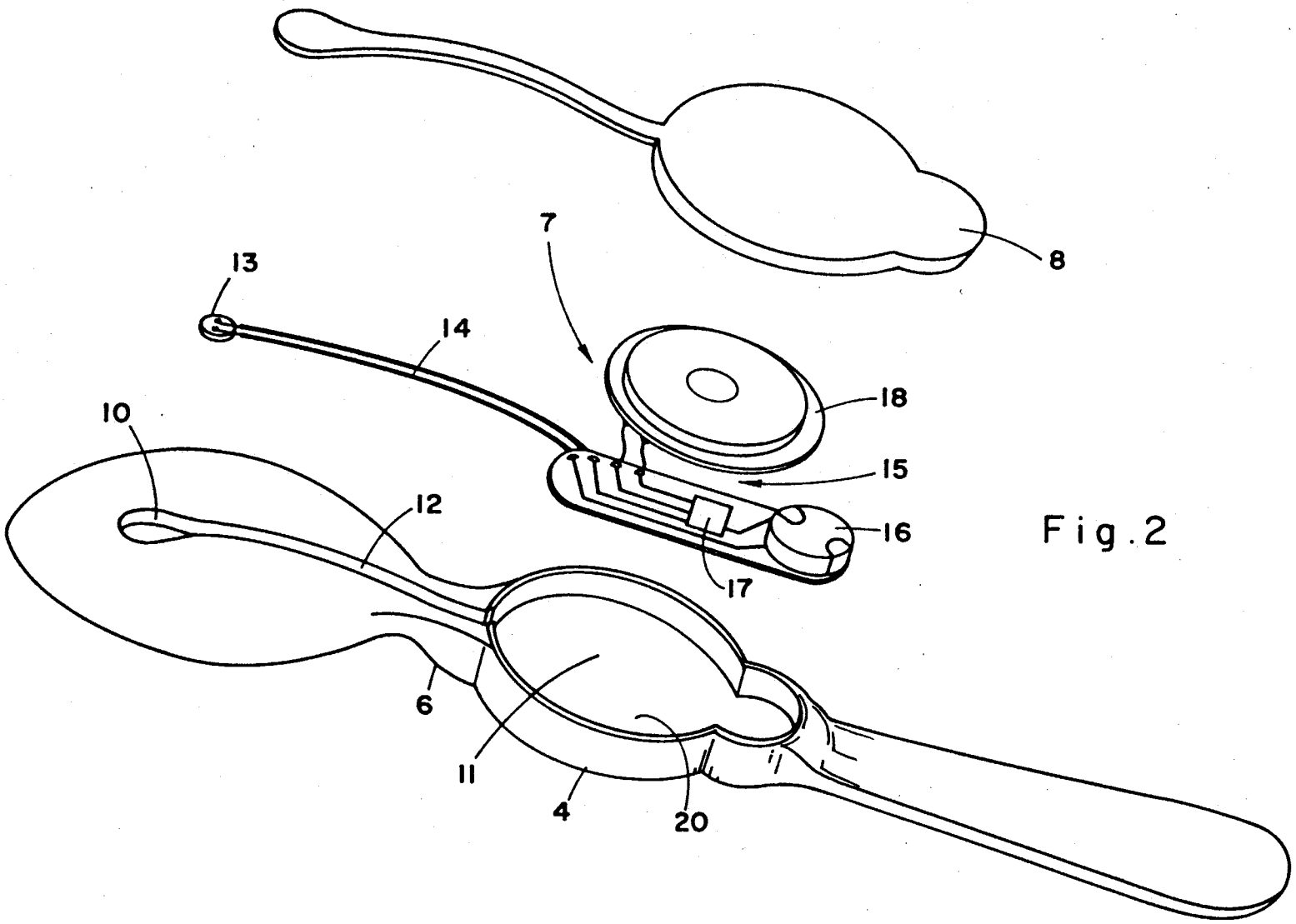
FIG. 2 shows a perspective, exploded, view from below of the spoon of FIG. 1.

In accordance with one embodiment of the present invention shown in FIG. 1, the cutlery piece is a spoon 1 comprising a bowl 2 and a handle 3 being integral with a broad portion 4 proximal to the bowl 2. Broad portion 4 holds the signal producing means (see below). As can be seen in FIG. 2, the spoon is an assembly of essentially three components—body 6, electronic means 7 and a cover member 8. The body 6 comprises an anterior recess 10 on the bottom face of bowl 2 and a main recess 11 in portion 4, the two recesses being connected by a groove 12.

Electronic means 7 comprise a light sensor 13 linked by a pair of cables 14 to signal generation means 15 comprising a battery 16, an electronic integrated circuit element 17 and a miniature loud speaker 18. Element 17 is adapted to transiently activate the loud speaker, so as to produce a short tune or the like, upon receipt of an electric signal from the light sensor 13 when same is exposed to light after a period of no light exposure during which no signal is received.

Figure 3:
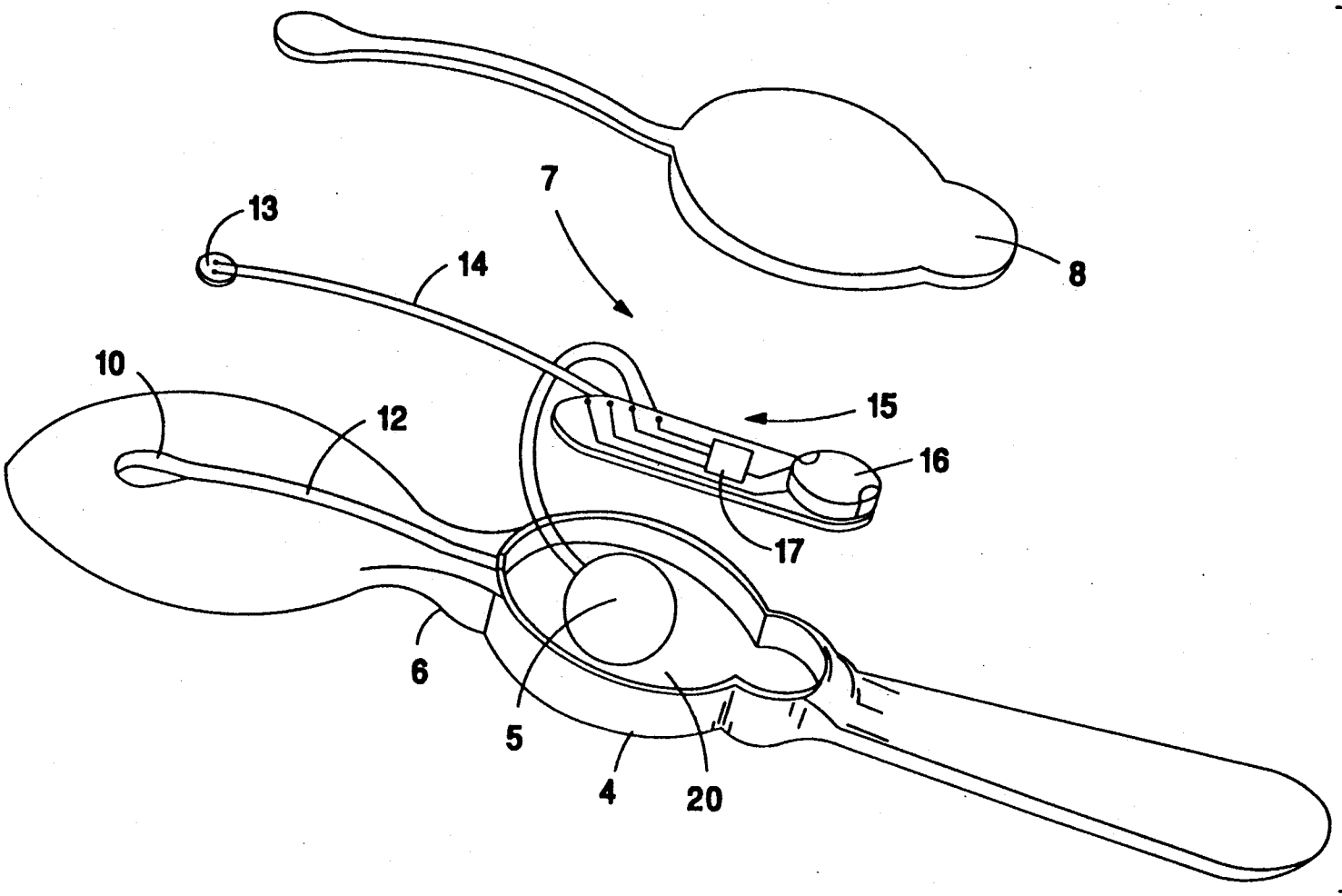
FIG. 3 shows a perspective, exploded view from below of another embodiment of the spoon of FIG. 1.

Similiary an LED 5, as shown in FIG. 3, may be provided in the signal generation means 15. As with the miniature loud speaker 18, the LED 5 is connected to the circuit element 17. Element 17 transitly activates LED 5 to produce a flash of light upon receipt of an electric signal from the light sensor 13 as discussed above.

Signal generating means are adapted to be received in recesses 10 and 11 and groove 12 and by sealing with cover member 8, an enclosed space holding the signal generating means 7 is formed, which is sealed as known per se either by gluing, by heat seal, etc. In the embodiment shown in FIG. 1, signal generation means are placed inside recess 11 in a manner that miniature loud speaker 18 faces cover member 8. It may at times be preferred to fit means 15 into recess 11 so that miniature loud speaker 18 faces wall 20 of recess 11. This is particularly desired where it is necessary to protect the loud speaker from damage, e.g. such which may occur if rather than sealing with cover member 8, the recess 11 is filled by casting, e.g. with molten plastic. It may at times be advantageous to construct a shallow dent in wall 20 adapted to receive the central, membrane containing portion of loud speaker 18 in a manner that it faces wall 20 and thereby the rim of the loud speaker and the shoulders of the dent will provide a higher degree of protection to the sensitive membrane of the loud speaker.

In the specific embodiment shown herein, the light sensor 13 faces downward in the orientation shown in FIG. 2 and is thus capable of detecting light coming from above in relation to the orientation in which spoon 1 is used for feeding. Accordingly, the portion of bowl 2 overlaying sensor 13 should transmit sufficient light to activate same. In other embodiments of the present invention, the sensor may face the opposite direction and in this case the same would apply for the overlaying portion of cover member 8.

Spoon 1 is suitably made of plastic or ceramic material.

We claim:

1. A cutlery piece which comprises:

a food holding portion having upper and lower faces;

a handle; and electronic means comprising a light sensor in said food holding portion and means to provide one of a light and a sound signal, said electronic means being adapted to transiently activate said means to provide said signal when at least one of the faces of the food holding portion is exposed to light after a period of darkness.

2. The cutlery piece according to claim 1, wherein said means to provide said signal is a miniature loud speaker.

3. The cutlery piece according to claim 1, wherein said electronic means is capable of transiently providing said signal upon receipt of an electric input from said sensor, and being capable of again providing said signal only after a certain period of time in which the electric input signal stopped.

4. The cutlery piece according to claim 1, wherein the electronic means are embedded or located in an enclosed space within said cutlery piece.

5. The cutlery piece according to claim 1, wherein said sensor is embedded or enclosed within a space in the food holding portion.

6. The cutlery piece according to claim 1, wherein the means to provide said signal is located at said handle.

7. The cutlery piece according to claim 1, wherein said cutlery piece is a spoon.

* * * * *